US007570891B2

(12) United States Patent
Horinoe

(10) Patent No.: US 7,570,891 B2
(45) Date of Patent: Aug. 4, 2009

(54) DEVELOPING CARTRIDGE, IMAGE CARRIER CARTRIDGE, PROCESS CARTRIDGE, AND IMAGE FORMING APPARATUS

(75) Inventor: Mitsuru Horinoe, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 485 days.

(21) Appl. No.: 11/531,968

(22) Filed: Sep. 14, 2006

(65) Prior Publication Data

US 2007/0058993 A1 Mar. 15, 2007

(30) Foreign Application Priority Data

Sep. 14, 2005 (JP) ..... 2005-266764

(51) Int. Cl.
*G03G 15/00* (2006.01)
*G03G 21/18* (2006.01)

(52) U.S. Cl. ..... 399/13; 399/113

(58) Field of Classification Search ..... 399/12, 399/13, 25, 27, 31, 64, 111, 113, 119
See application file for complete search history.

(56) References Cited

U.S. PATENT DOCUMENTS

| | | | | |
|---|---|---|---|---|
| 5,398,106 | A | 3/1995 | Eguchi | |
| 5,589,915 | A * | 12/1996 | Hashimoto | 399/120 |
| 5,617,188 | A * | 4/1997 | Inomata | 399/13 |
| 5,893,006 | A * | 4/1999 | Kanno et al. | 399/13 |
| 5,893,007 | A * | 4/1999 | Lim | 399/13 |
| 5,933,678 | A * | 8/1999 | Park | 399/27 |
| 6,137,966 | A * | 10/2000 | Uehara et al. | 399/13 |
| 6,751,428 | B2 | 6/2004 | Okabe | |
| 6,763,198 | B2 | 7/2004 | Matsumoto | |
| 6,885,831 | B2 * | 4/2005 | Lee | 399/13 |
| 7,242,874 | B2 * | 7/2007 | Tsusaka | 399/13 |
| 2004/0265000 | A1 | 12/2004 | Okabe | |

FOREIGN PATENT DOCUMENTS

| | | | |
|---|---|---|---|
| JP | 01319065 | A * | 12/1989 |
| JP | 03216666 | A * | 9/1991 |
| JP | 5-35097 | A | 2/1993 |
| JP | 5-165332 | A | 7/1993 |
| JP | 5-197281 | A | 8/1993 |
| JP | 10-161414 | A | 6/1998 |
| JP | 10-207323 | A | 8/1998 |

(Continued)

*Primary Examiner*—Robert Beatty
(74) *Attorney, Agent, or Firm*—Banner & Witcoff, Ltd.

(57) ABSTRACT

Several different apparatuses are provided that can be configured to detect whether a developing cartridge, an image carrier cartridge, and a process cartridge are installed in an image forming apparatus. A shielding member is configured to move between a blocking position where the shielding member blocks light emitted from a detector provided in the main body frame of an image forming apparatus and an unblocking position where the shielding member does not block the light emitted from the detector. The shielding member is in the blocking position when the developing cartridge is removed from an image carrier cartridge and in the unblocking position when the developing cartridge is installed in the image carrier cartridge. Also, an installation detecting device may be provided to determine whether an image carrier cartridge and a developing cartridge are installed in the main body frame based on the amount of the light received by a detector.

11 Claims, 10 Drawing Sheets

FOREIGN PATENT DOCUMENTS

| | | | |
|---|---|---|---|
| JP | 10-301358 | A | 11/1998 |
| JP | 2002-040891 | A | 2/2002 |
| JP | 2003-057904 | A | 2/2003 |
| JP | 2003-84645 | A | 3/2003 |
| JP | 2005-128137 | A | 5/2005 |

* cited by examiner

DEVELOPING CARTRIDGE, IMAGE CARRIER CARTRIDGE, PROCESS CARTRIDGE, AND IMAGE FORMING APPARATUS

CROSS REFERENCE TO RELATED APPLICATION

This application claims priority from Japanese Patent Application No. 2005-266764, filed Sep. 14, 2005, the entire content of which is incorporated herein by reference.

FIELD

Aspects of the invention relate to a developing cartridge, an image carrier cartridge, a process cartridge, and an image forming apparatus.

BACKGROUND

A known electrophotographic image forming apparatus, removably sets therein a developing cartridge configured to hold toner, as a developing agent. Such an image forming apparatus is generally provided with a detection device that determines whether the developing cartridge is installed in the image forming apparatus. When it is determined that the developing cartridge is not installed in the image forming apparatus, the apparatus indicates as such, to prevent a printing operation from being performed with the developing cartridge uninstalled. For example, Japanese Laid-Open Patent Publication No. 5-35097 discloses an electrophotographic apparatus in which installation of the developing cartridge is detected by an optical sensor (toner empty sensor).

For example, Japanese Laid-Open Patent Publication No. 2003-84645 discloses an image forming apparatus including a photoconductive cartridge having a photoconductive element as an image carrier, and a developing cartridge removably installed in the photoconductive cartridge. In the image forming apparatus, the photoconductive cartridge and the developing cartridge are independent of each other, so that the photoconductive cartridge and the developing cartridge can be replaced separately at their appropriate timing, achieving cost efficiency.

Even when the structure disclosed in Japanese Laid-Open Patent Publication No. 5-35097 is applied to the image forming apparatus disclosed in Japanese Laid-Open Patent Publication No. 2003-84645, installation/uninstallation of the photoconductive cartridge cannot be detected. More specifically, when the developing cartridge is not installed in the image forming apparatus, it cannot be determined whether neither the photoconductive cartridge nor the developing cartridge is installed in the image forming apparatus or whether only the developing cartridge is not installed in the image forming apparatus even though the photoconductive cartridge is properly installed in the image forming apparatus.

SUMMARY

According to aspects of the invention, a developing cartridge, an image carrier cartridge, a process cartridge, and an image forming apparatus are provided that are configured to detect whether the developing cartridge, the image carrier cartridge, and the process cartridge are installed in the image forming apparatus.

BRIEF DESCRIPTION OF THE DRAWINGS

Aspects of the invention will be described in detail with reference to the following figures wherein.

DETAILED DESCRIPTION

1. General Structure of Image Forming Apparatus

Figure 1:
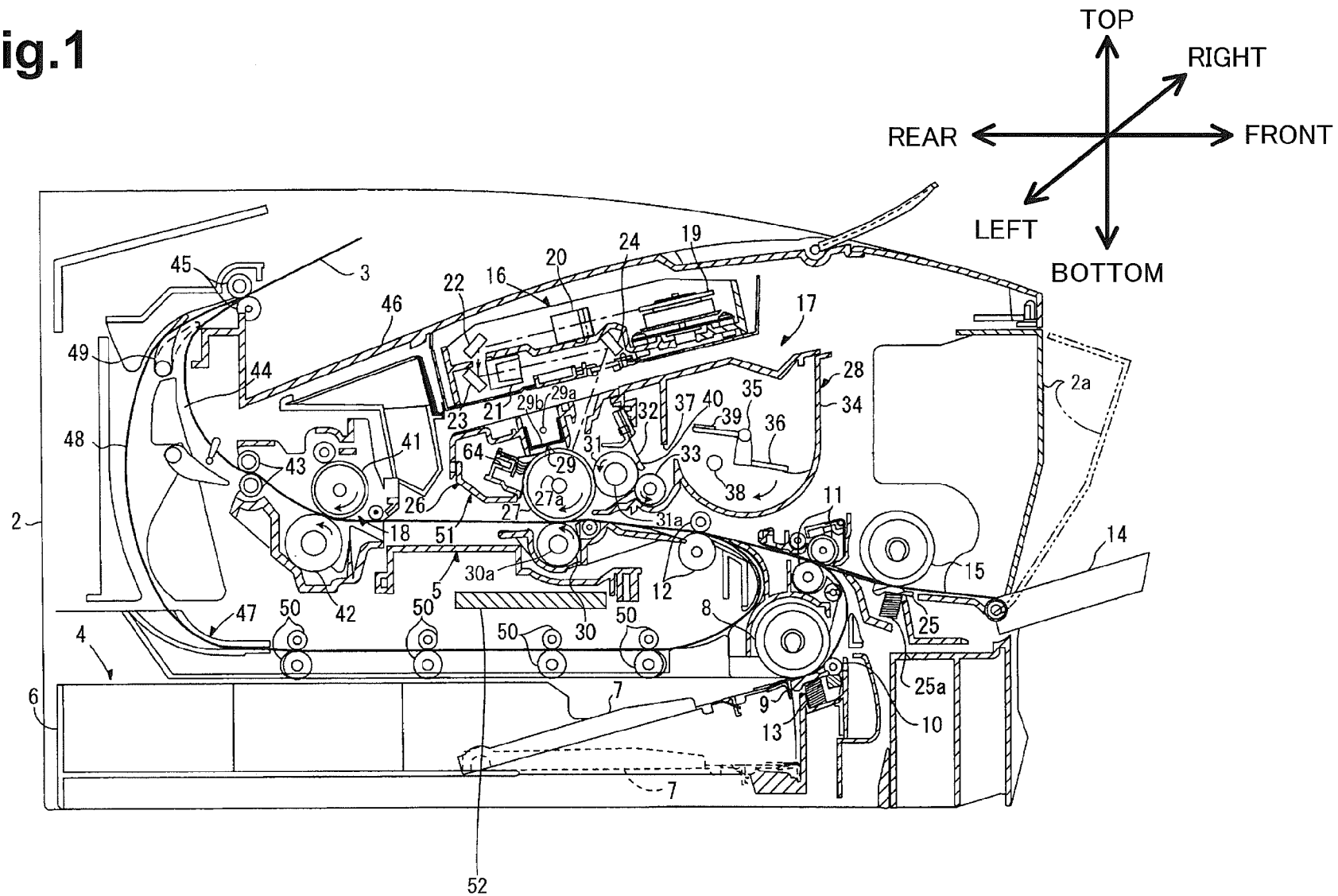
FIG. 1 is a side cross sectional view of a laser printer as an image forming apparatus according to an illustrative aspect.

In FIG. 1, a laser printer 1 according to an illustrative aspect is provided in a main body frame 2 with a feeder section 4 for feeding sheets 3 and an image forming section 5 for forming images on the sheets 3. The right side in FIG. 1 is defined as the front side and the left side is defined as the rear side.

(1) Feeder Section

The feeder section 4 includes a sheet supply tray 6 removably set on a bottom of the main body frame 2, a sheet mount plate 7 disposed in the sheet supply tray 6, a pickup roller 8 and a separation pad 9 disposed at a front upper end of the sheet supply tray 6, sheet power removing rollers 10, 11 disposed downstream of the pickup roller 8 in a sheet feeding direction, and register rollers 12 disposed downstream of the sheet power removing rollers 11, 12 in the sheet feeding direction.

The sheet mount plate 7 is disposed so as to allow the sheets 3 to be stacked thereon. The sheet mount plate 7 is pivotally supported on one end (rear end) far from the pickup roller 8 so that the other end (front end) of the sheet mount plate 7 near the pickup roller 8 is movable in a vertical direction. Disposed on the underside of the sheet mount plate 7 is a spring (not shown) that urges the sheet mount plate 7 upwardly. As the amount of the sheets 3 stacked on the sheet mount plate 7 increases, the sheet mount plate 7 pivots downward about the rear end far from the pickup roller 8, against an urging force of the spring.

The pickup roller 8 and the separation pad 9 are disposed so as to face each other. The separation pad 9 is pressed against the pickup roller 8 by a spring 13 disposed on an underside of the separation pad 9.

An uppermost sheet 3 on the sheet mount plate 7 is pressed toward the pickup roller 8 as the sheet mount plate 7 is urged upwardly by the spring (not shown). By the rotation of the pickup roller 8, the uppermost sheet 3 is held between the pickup roller 8 and the separation pad 9. The sheets 3 are separated one by one in cooperation with the pickup roller 8 and the separation pad 9.

The separated sheet 3 is delivered to the sheet powder removing rollers 10, 11 where sheet powders or fibers on the sheet 3 are removed. Then, the sheet 3 is conveyed to the register rollers 12. The register rollers 12 include a pair of rollers. The register rollers 12 reduce the skew of the sheets 3, and then feed the sheets 3 to an image forming position where a photoconductive drum 27 and a transfer roller 30 (described below) contact each other. In the image forming position, a toner image on a photoconductive drum 27 is transferred on the sheet 3.

The feeder section 4 of the laser printer 1 further includes a multi-purpose tray 14, a multi-purpose pickup roller 15 and a multi-purpose separation pad 25 for feeding the sheets 3 mounted on the multi-purpose tray 14. The multi-purpose tray 14 and the multi-purpose pickup roller 15 are disposed so as to face each other. The multi-purpose separation pad 25 is pressed toward the multi-purpose pickup roller 15 by a spring 25*a* disposed on an underside of the multi-purpose separation pad 25.

By the rotation of the multi-purpose pickup roller 15, the sheets 3 on the multi-purpose tray 14 are held between the multi-purpose pickup roller 15 and the multi-purpose separation pad 25 and separated one by one.

(2) Image forming section

The image forming section 5 includes a scanner unit 16, a process cartridge 17, and a fixing unit 18.

(a) Scanner Unit

The scanner unit 16 is disposed in an upper portion of the main body frame 2. The scanner unit 16 includes a laser emitting portion (not shown), a polygon mirror 19 that is driven so as to spin, lenses 20, 21, and reflecting mirrors 22, 23, 24. A laser beam is emitted from the laser emitting portion based on image data. The laser beam emitted from the laser emitting portion passes through or reflects off the polygon mirror 19, the lens 20, the reflecting mirrors 22, 23, the lens 21, and the reflecting mirror 24 in this order, as indicated by broken lines in FIG. 1, to irradiate a surface of the photoconductive drum 27 of the process cartridge 17.

(b) Process Cartridge

The process cartridge 17 is disposed below the scanner unit 16. The process cartridge 17 includes a drum cartridge 26, as a photoconductive cartridge or an image carrier cartridge, which is removably installed in the main body frame 2, and a developing cartridge 28 that is set in the drum cartridge 26. As shown in FIG. 1, a front cover 2*a* on a front face of the main body frame 2 is pivotally provided about a lower end so as to open or close. The process cartridge 17 is removably installed in the main body frame 2 by opening the front cover 2*a*.

The developing cartridge 28 is removably set in the drum cartridge 26. The developing cartridge 28 includes a developing roller 31, as a developer carrier, a layer thickness regulating blade 32, a supply roller 33, and a toner chamber 34 as a developer container.

The toner chamber 34 accommodates, as developer, positively chargeable non-magnetic single component toner. The toner is, for example, polymerized toner that is obtained by copolymerizing polymerizable monomers using a known polymerization method, such as a suspension polymerization method. The polymerizable monomers may be styrene-based monomers, such as styrene, and acrylic-based monomers, such as acrylic acid, alkyl (C1-C4) acrylate, and alkyl (C1-C4) methacrylate. The particle shape of such polymerized toner is substantially spherical, and thus the polymerized toner has excellent fluidity and contributes to high-quality image formation.

The toner is mixed with a coloring material, such as carbon black, and wax, as well as an external additive, such as silica, to improve the fluidity of the toner. Toner particle sizes are approximately 6 to 10 μm.

Figure 2:
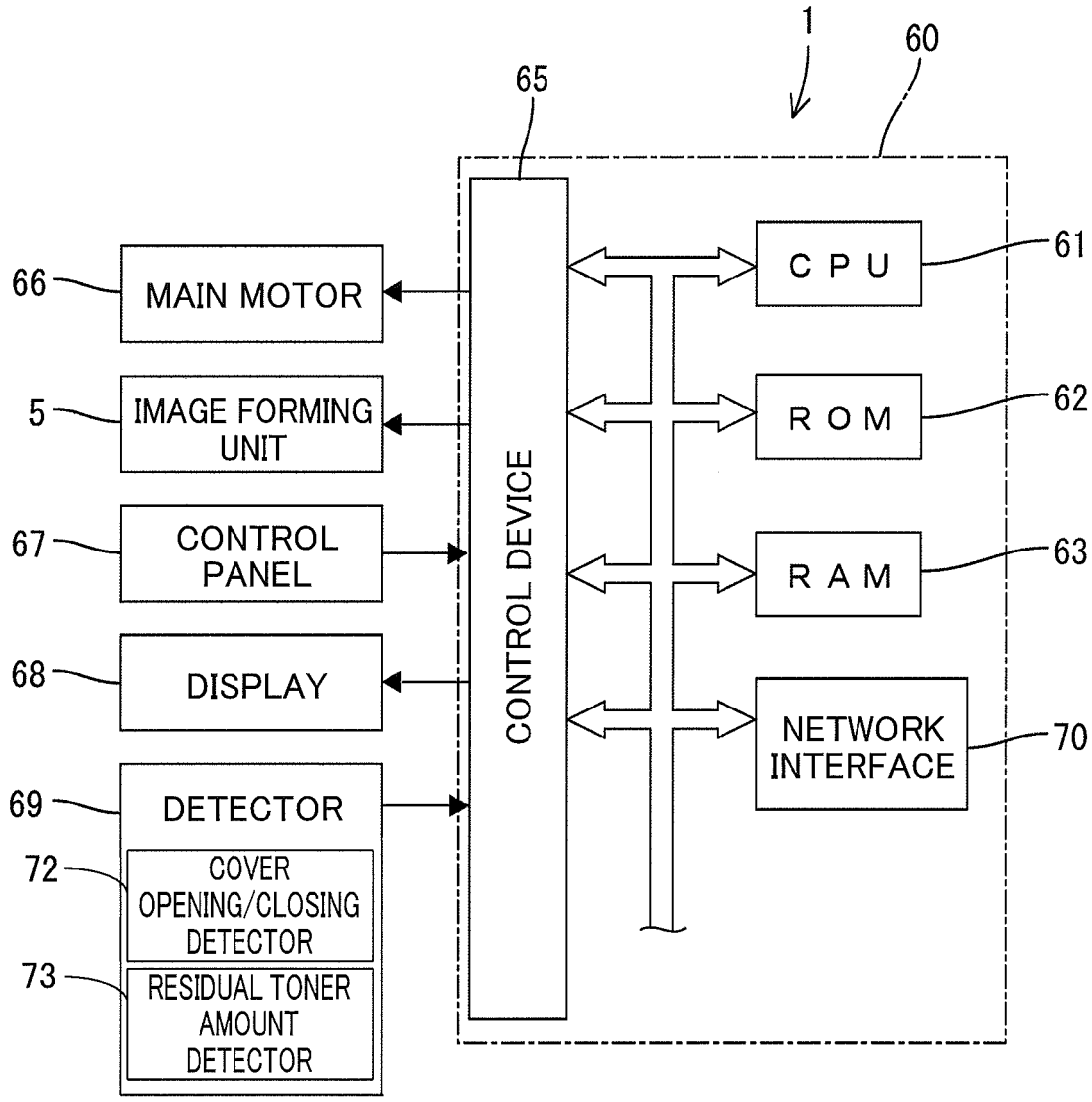
FIG. 2 is a block diagram showing an electrical configuration of the laser printer.

An agitator 36 is supported by a rotating shaft 35 provided in the center of the toner chamber 34. The toner in the toner chamber 34 is agitated by the agitator 36 and discharged from a toner supply opening 37 provided on the rear side of the toner chamber 34. The agitator 36 is rotated in the clockwise direction as indicated by the arrow in FIG. 1, as drive force is input thereto from a main motor 66 (FIG. 2). Residual toner amount detecting windows 38 are disposed on sidewalls of the toner chamber 34, which are provided in the thickness direction of the sheet of FIG. 1. The residual toner amount detecting windows 38 are wiped off by a wiper 39 supported by the rotating shaft 35.

The supply roller 33 is rotatably disposed behind the toner supply opening 37. The developing roller 31 is rotatably disposed opposite to the supply roller 33. The supply roller 33 and the developing roller 31 contact each other so as to apply pressure against each other.

The supply roller 33 includes a metal roller shaft covered by a roller portion formed of conductive foam. The supply roller 33 is rotatable in the counterclockwise direction, as indicated by the arrow in FIG. 1, as the drive force is input thereto from the main motor 66.

The developing roller 31 includes a metal roller shaft covered by a roller portion formed of a conductive rubber material. More specifically, the roller portion of the developing roller 31 includes a roller body and a coating layer. The roller body may be formed of conductive urethane rubber or silicone rubber including fine carbon particles. The coating layer is provided on a surface of the roller body. The coating layer may be urethane rubber or silicone rubber including fluorine. A development bias voltage is applied to the developing roller 31 during development from a bias application circuit (not shown). The bias application circuit is mounted on a high-voltage power supply circuit board 52 disposed in the main body frame 2 below the process cartridge 17. The developing roller 31 is rotated in the counterclockwise direction as indicated by the arrow in FIG. 1, as drive force is input thereto from the main motor 66.

The layer thickness regulating blade 32 is disposed near the developing roller 31. The regulating blade 32 includes a blade body formed of a leaf spring member, and a pressing portion 40 formed of insulating silicone rubber. The pressing portion 40 has a semi-circular cross-section and is disposed at one end of the blade boy. The layer thickness regulating blade 32 is supported near the developing roller 31 by the developing cartridge 28. The pressing portion 40 is pressed against the surface of the developing roller 31 with the elasticity of the blade body.

The toner discharged from the toner supply opening 37 is supplied to the developing roller 31 by the rotation of the supply roller 33. At this time, the toner is positively charged by the friction between the supply roller 33 and the developing roller 31. The charged toner carried onto the surface of the developing roller 31 passes between the developing roller 31 and the pressing portion 40 of the regulating blade 32, as the developing roller 31 rotates. Thus, the toner is carried on the surface of the developing roller 31 as a thin layer whose thickness has been regulated.

The drum cartridge 26 includes a cartridge frame 51, the photoconductive drum 27 as an image carrier disposed in the cartridge frame 51, a scorotron charger 29, a transfer roller 30, and a cleaning brush 64. The cartridge frame 51 will be described in detail below.

The photoconductive drum 27 is disposed behind the developing roller 31 to face the developing roller 31. The photoconductive drum 27 is rotatably supported by the cartridge frame 51. The photoconductive drum 27 includes a cylindrical drum, and a metal drum shaft 27*a* that is disposed along the axis of the drum body. The cylindrical drum may be formed of aluminum. Positively chargeable photoconductive coating layer made from polycarbonate is formed on the surface of the aluminum cylindrical drum. The photoconductive drum 27 is rotated in the clockwise direction as indicated by the arrow in FIG. 1, as drive force is input thereto from the main motor 66.

The scorotron charger 29 is supported in the drum cartridge 26 above the photoconductive drum 27 with a predetermined distance therebetween, to prevent the scorotron charger 29 from contacting the photoconductive drum 27. The charger 29 is a positively charging scorotron charger that generates corona discharge from a charging wire 29*a* such as a tungsten wire. The charger 29 includes the charging wire 29*a* and a grid electrode 29*b*. The charger 29 uniformly and positively charges the surface of the photoconductive drum 27. A charge bias voltage is applied to the charging wire 29*a* from a bias application circuit (not shown).

The surface of the photoconductive drum 27 is uniformly and positively charged by the scorotron charger 29 while the photoconductive drum 27 rotates. Then, the surface of the photoconductive drum 27 is selectively exposed to the laser beam emitted from the scanner unit 16, to form an electrostatic latent image on the surface of the drum 27, based on image data.

Thereafter, as the toner, which is carried on the developing roller 31 and is positively charged, is brought into contact with the photoconductive drum 27 in accordance with the rotation of the developing roller 31, the toner is supplied to the electrostatic latent image formed on the surface of the photoconductive drum 27. Thus, the toner is selectively carried on the photoconductive drum 27 making the toner image visible.

The transfer roller 30 is disposed below the photoconductive drum 27 to face the photoconductive drum 27. The transfer roller 30 is rotatably supported by the drum cartridge 26. The transfer roller 30 includes a metal roller shaft 30*a* covered by a roller portion formed of conductive rubber material. A transfer bias is applied to the transfer roller 30 from the bias application circuit during transfer of the toner to the sheet 3. The transfer roller 30 is rotated in the counterclockwise direction as indicated by the arrow in FIG. 1, as drive force is input thereto from the main motor 66.

The cleaning brush 64 is disposed so as to contact the drum body of the photoconductive drum 27. The cleaning brush 64 is formed of a conductive material. A cleaning bias is applied to the cleaning brush 64 from the bias application circuit to electrically suction and remove negatively charged sheet powders or fibers attached to the photoconductive drum 27.

(c) Fixing Unit

The fixing unit 18 is positioned downstream of the process cartridge 17 in the sheet feeding direction behind the process cartridge 17, as shown in FIG. 1. The fixing unit 18 includes a heat roller 41, a pressure roller 42 pressed against the heat roller 41, and a pair of feed rollers 43 disposed downstream of the heat roller 41 and the pressure roller 42 in the sheet feeding direction. The heat roller 41 includes a metal tube accommodating a halogen lamp for heat application. The heat roller 41 is rotated in the clockwise direction as indicated by the arrow in FIG. 1, as the drive force is input thereto from the main motor 66. The pressure roller 42 follows the rotation of the heat roller 41 and is rotated in the counterclockwise direction as indicated by the arrow in FIG. 1 while being pressed against the heat roller 41.

In the fixing section 18, the toner transferred onto the sheet 3 in the process cartridge 17 is thermally fixed to the sheet 3 while the sheet 3 passes through between the heat roller 41 and the pressure roller 42. Then, the sheet 3 is conveyed by the feed rollers 43 to a sheet output path 44. The sheet 3 fed to the sheet output path 44 is conveyed to sheet output rollers 45 and output to a sheet output tray 46 by the output rollers 45.

The laser printer 1 includes a duplex printing unit 47 to allow an image to be formed on both sides of the sheet 3. The duplex printing unit 47 includes the output rollers 45, a reverse feeding path 48, a flapper 49, and feeding rollers 50.

2. Electrical Configuration of Laser Printer

Electrical configuration of the laser printer 1 will be described referring to FIG. 2. The laser printer 1 includes a controller 60 that controls components of the laser printer 1 using a central processing unit (CPU) 61, a read only memory (ROM) 62, a random access memory (RAM) 63, and a control device 65 of an application specific integrated circuit (ASIC). The control device 65 is electrically connected to the main motor 66, a main power supply switch (not shown), a control panel 67 including a various keys to be operated by a user, a display 68 such as a liquid crystal panel, and a detector 69 including various sensors.

The ROM 62 and the RAM 63 are connected to the CPU 61. The CPU 61 controls components of the laser printer 1, via the control device 65, in accordance with processing procedures stored in the ROM 62 while storing processing results in the RAM 63. The CPU 61 may correspond to an installation detecting device.

The main motor 66 (corresponding to a drive device) rotates, for example, the developing roller 31, the agitator 36, the photoconductive drum 27, the transfer roller 30, the heat roller 41, and the register rollers 12 in synchronization with each other. The CPU 61 performs drive control for the main motor 66 based on programs stored in the ROM 62.

The control device 65 controls the image forming unit 5, based on a command from the CPU 61. More specifically, the control device 65 performs, for example, an exposure control for exposing the surface of the photoconductive drum 27 with the components of the scanner unit 16, and a transfer bias application control when toner is transferred onto the sheet 3 from the photoconductive drum 27.

The controller 60 further includes a network interface 70 to connect with an external device, such as a personal computer. The CPU 61 performs drive controls for the various components of the printer 1, as described above, to form an image based on image data, which is input through the network interface 70, on the sheet 3.

Figure 3:
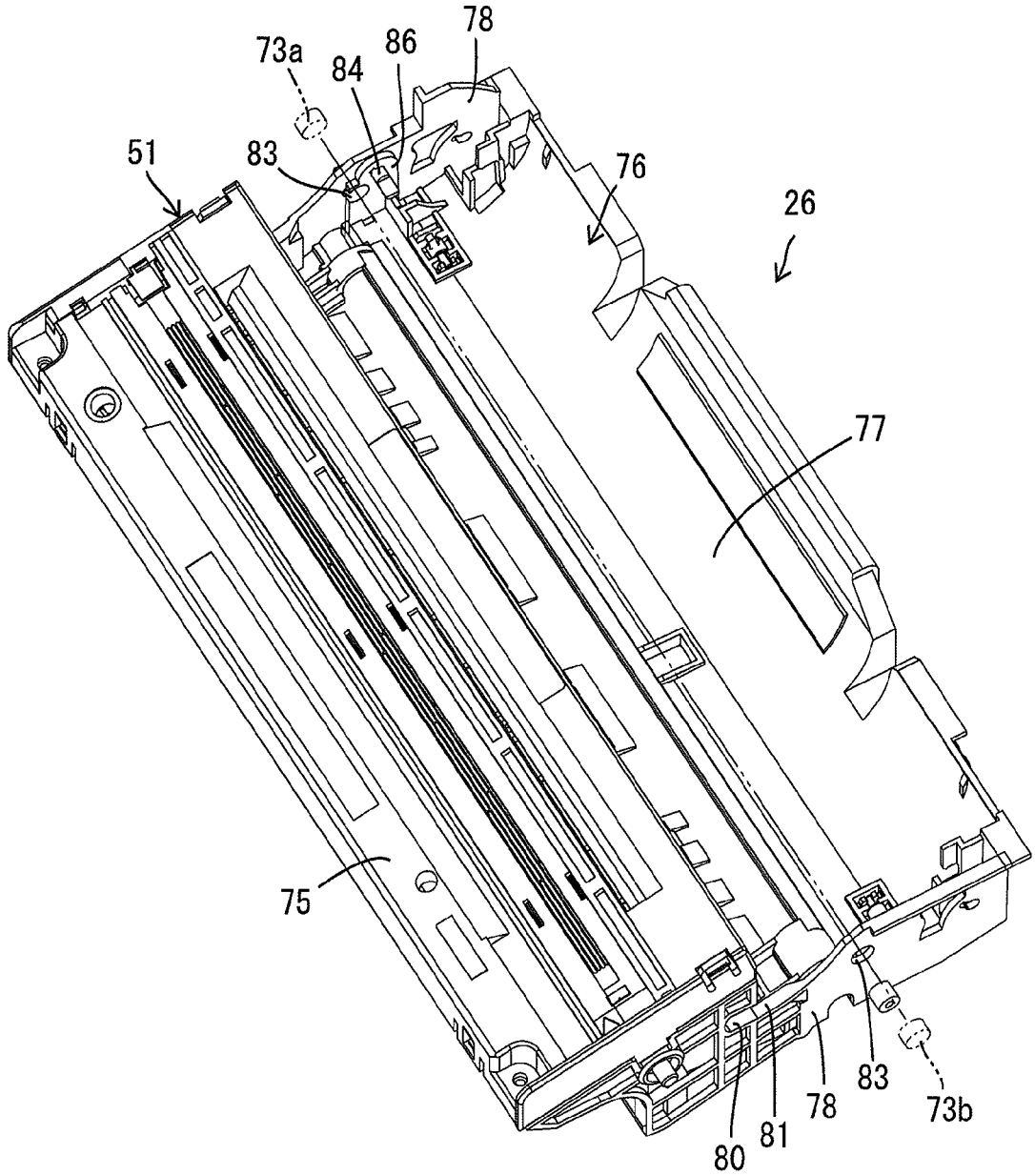
FIG. 3 is a perspzective view of a drum cartridge to be installed in the laser printer.

The detector 69 includes a cover opening/closing detector 72 and a residual toner amount detector 73. The cover opening/closing detector 72 includes a phototransmitter and a photoreceiver (not shown) that are disposed opposite to each other. The cover opening/closing detector 72 outputs a signal corresponding to an opening or closing condition of the front cover 2*a*, based on whether a light beam emitted from the phototransmitter toward the photoreceiver is blocked by a part of the front cover 2*a*. The residual toner amount detector 73 (corresponding to a detector) includes a phototransmitter 73*a* and a photoreceiver 73*b*, as shown in FIG. 3, that are disposed in the main body frame 2 opposite to each other so as to sandwich the process cartridge 17 therebetween from its right and left sides when the process cartridge 17 is installed in the main body frame 2. A light beam is emitted from the phototransmitter 73*a* to the photoreceiver 73*b*. The photoreceiver 73*b* outputs voltages according to the amounts of the light beam received.

3. Structures of Shielding Member and its Periphery

A shielding member 84 provided in the drum cartridge 26 will be described referring to FIGS. 3 through 11.

Figure 4:
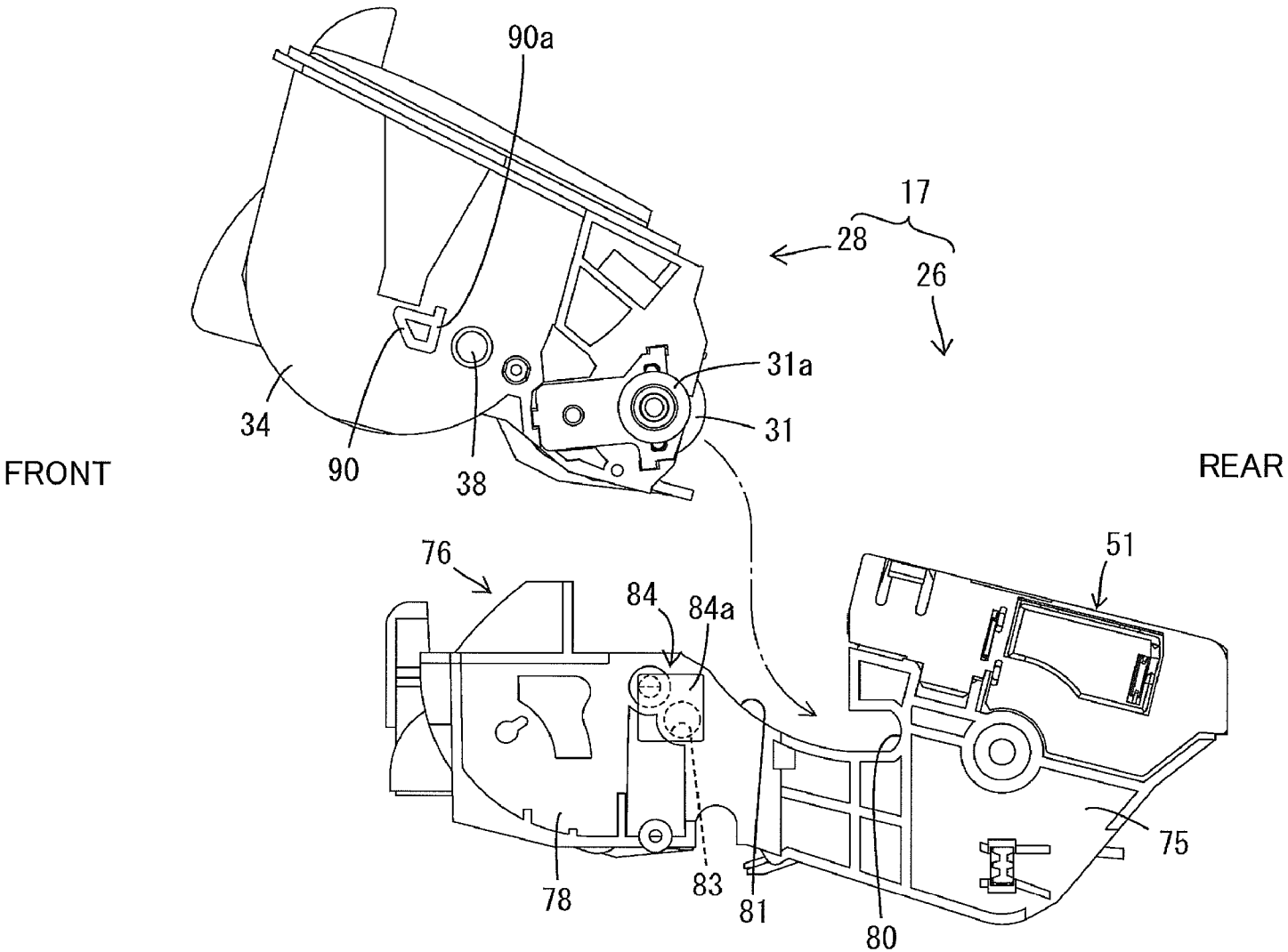
FIG. 4 is a side view of the drum cartridge and a developing cartridge before the developing cartridge is set in the drum cartridge.

As shown in FIGS. 3 and 4, the cartridge frame 51 of the drum cartridge 26 is integrally provided with a drum accommodating portion 75 configured to accommodate the photoconductive drum 27 and the transfer roller 30 and a cartridge accommodating portion 76 configured to accommodate the developing cartridge 28. The cartridge accommodating portion 76 is formed by a bottom plate 77 of the cartridge frame 51 and side plates 78 extending upward from each end of the bottom plate 77 with respect to its longitudinal direction into an upwardly-open "U" shape in cross section. The front side of the bottom plate 77 is formed in a curve along the shape of the developing cartridge 28. The side plates 78 are formed with cartridge installation grooves 80 that are open forwardly. The cartridge installation grooves 80 receive the roller shaft 31*a* of the developing roller 31 that extends outward from a case of the developing cartridge 28. The side plates 78 are formed with guide edges 81 that connect with lower ends of the cartridge installation grooves 80 substantially along an arc. The developing cartridge 28 is guided to its proper installation position in the cartridge accommodating portion 76 while the roller shaft 31*a* slides on the guide edges 81 toward the cartridge installation grooves 80. When the roller shaft 31*a* is received in the cartridge installation grooves 80, the developing cartridge 28 is positioned in the installation position where the developing roller 31 and the photoconductive drum 27 are brought into contact with each other.

Each side wall 78 has a round through hole 83 at a position associated with the window 38 of the developing cartridge 28. When the drum cartridge 26 and the developing cartridge 28 are installed in the main body frame 2, a pair of the through holes 83 of the drum cartridge 26 and a pair of the windows 38 of the developing cartridge 28 are aligned with an optical path of the light beam transmitted from the phototransmitter 73*a* to the photoreceiver 73*b* of the residual toner amount detector 73 as indicated by double dashed chain lines in FIG. 3.

Figure 5:
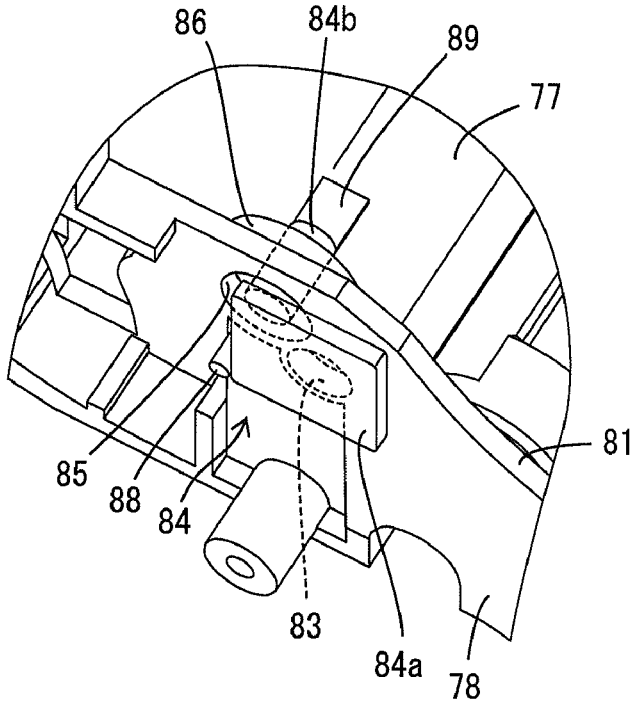
FIG. 5 is a partially enlarged perspective view showing a blocking member in a blocking position.
Figure 6:
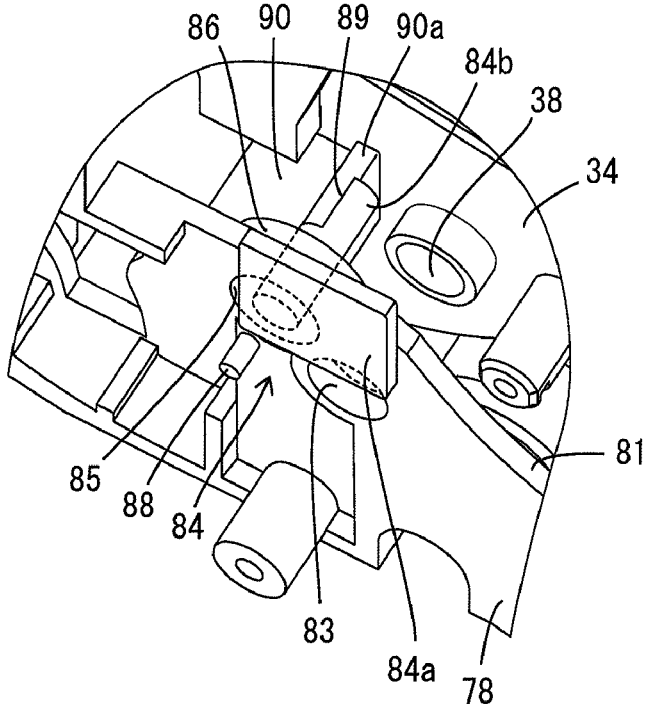
FIG. 6 is a partially enlarged perspective view showing the blocking member in an unblocking position.
Figure 7:
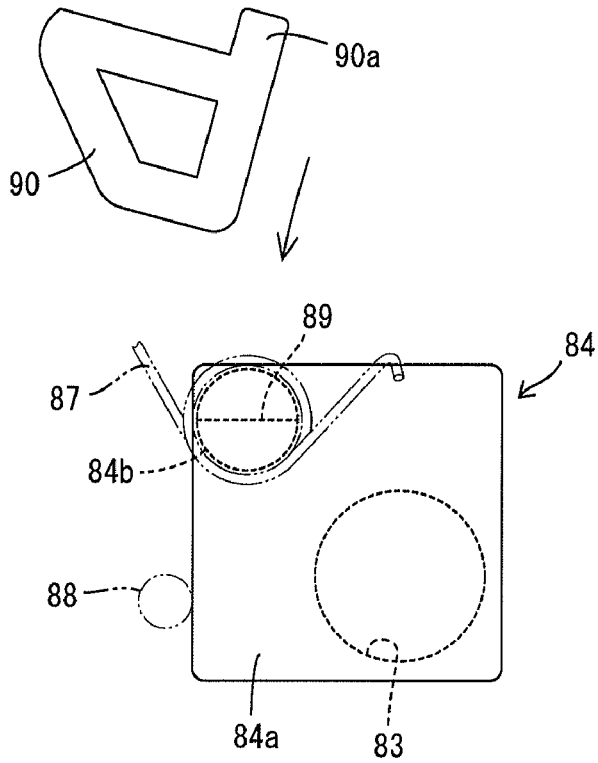
FIG. 7 is a partially enlarged side view showing the blocking member in the blocking position.
Figure 9:
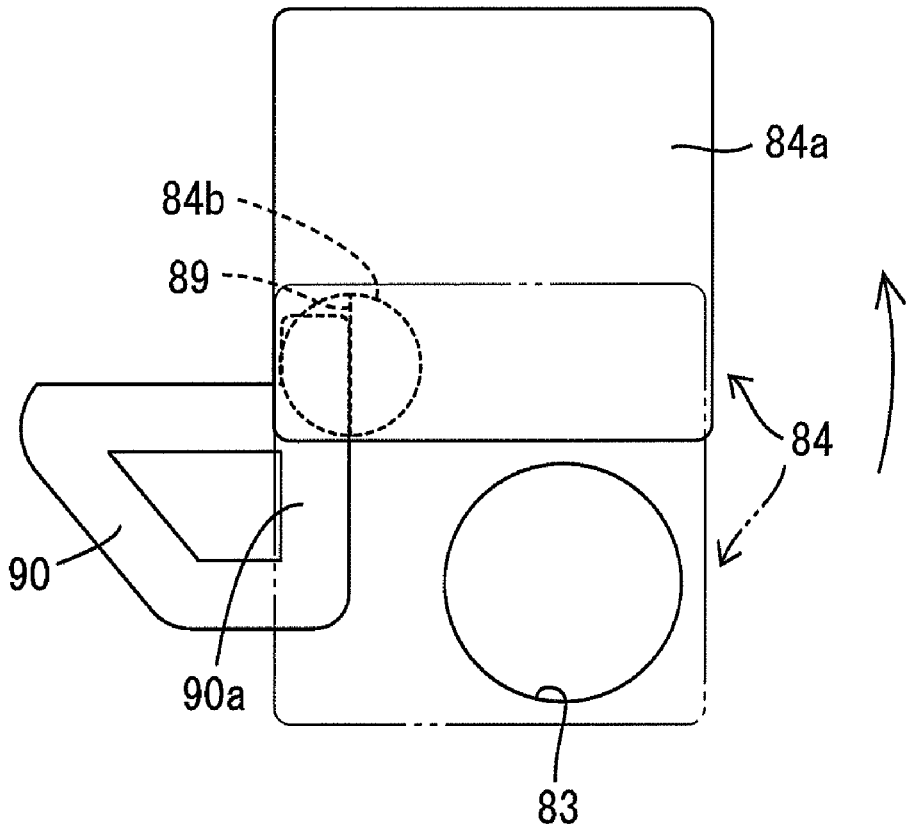
FIG. 9 is a partially enlarged side view showing the blocking member in the unblocking position.

As shown in FIGS. 5 and 7, a shielding member 84 that can close the through hole 83 is attached to the right side wall 78. The shielding member 84 includes a shielding plate 84*a* of a substantially square shape and an attachment shaft 84*b* of a substantially column shape. The attachment shaft 84*b* extends perpendicular to the shielding plate 84*a* from a corner of the shielding plate 84*a*. The attachment shaft 84*b* is inserted into an insertion hole 85 formed at an upper front portion of the through hole 83 in the side wall 78 and fitted in an attachment hole (not shown) formed in a supporting plate 86 disposed along an inner surface of the side wall 78. With such a structure, the shielding member 84 is rotatably supported on the attachment shaft 84*b*. The shielding member 84 can take a blocking position, as shown in FIGS. 5 and 7 and an unblocking position, as shown in FIGS. 6 and 9. In the blocking position, the shielding plate 84*a* closes the through hole 83 so that the light beam is blocked or intercepted. In the unblocking position, the shielding plate 84*a* is upwardly moved approximately 90 degrees from the blocking position so that the shielding plate 84 does not cover the through hole 83 and the light beam is not blocked by the shielding plate 84*a*. Further, as shown in FIG. 7, a spring 87 is fitted over the attachment shaft 84*b*. With the spring 87, the shielding member 84 is urged from the unblocking position side toward the blocking position side (in the clockwise direction in FIG. 7).

It should be noted that the spring 87 is only shown in FIG. 7 for the simplicity of illustration. When the developing cartridge 28 is not accommodated in the cartridge accommodating portion 76, the shielding member 84 is held in the blocking position as the shielding plate 84*a* contacts a stopper 88 protruding from the outer surface of the side plate 78. An end of the attachment shaft 84*b* is formed to have a "D" shape in cross section. Thus, a flat guide surface 89 is formed on the attachment shaft 84.

As shown in FIG. 4, a pressing portion 90 is provided in front of the window 38 to extend from the right side wall of the case of the developing cartridge 28 when viewed from the front side. The pressing portion 90 has a flat rear portion 90*a*, which is placed proximate to the window 38 and extends substantially vertically.

When the developing cartridge 28 is not set in the drum cartridge 26, the shielding member 84 is urged by the spring 87 and placed in the blocking position where the shielding plate 84*a* closes the through hole 83, as shown in FIGS. 5 and 7. In the blocking position, the guide surface 89 of the attachment shaft 84*b* is placed substantially horizontally, facing upward.

Figure 8:
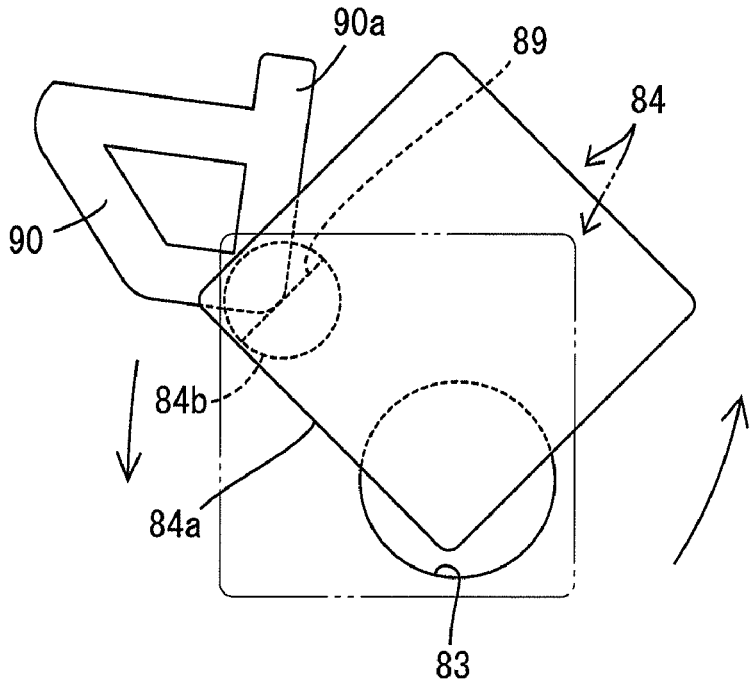
FIG. 8 is a partially enlarged side view showing the blocking member is moved from the blocking position to the unblocking position.

When the developing cartridge 28 is set in the drum cartridge 26, the roller shaft 31 of the developing cartridge 28 is placed on the guide edges 81 and is slid toward the cartridge installation grooves 80. As the developing cartridge 28 approaches its proper installation position in the drum cartridge 26, the developing cartridge 28, whose rear side is slightly slanted to the downside, moves in the counterclockwise direction in FIG. 4, such that the front side of the developing cartridge 28 is moved down. While the developing cartridge 28 is thus moved, the lower end (corner) of the rear portion 90*a* of the pressing portion 90 contacts the guide surface 89 of the attachment shaft 84*b* at a position slightly in front of an axis of the attachment shaft 84*b*, and presses the guide surface 89, as shown in FIG. 8. Thus, the shielding member 84 is pivotally moved in the counterclockwise direction in FIG. 8 about the attachment shaft 84*b* against the urging force of the spring 87.

Figure 10:
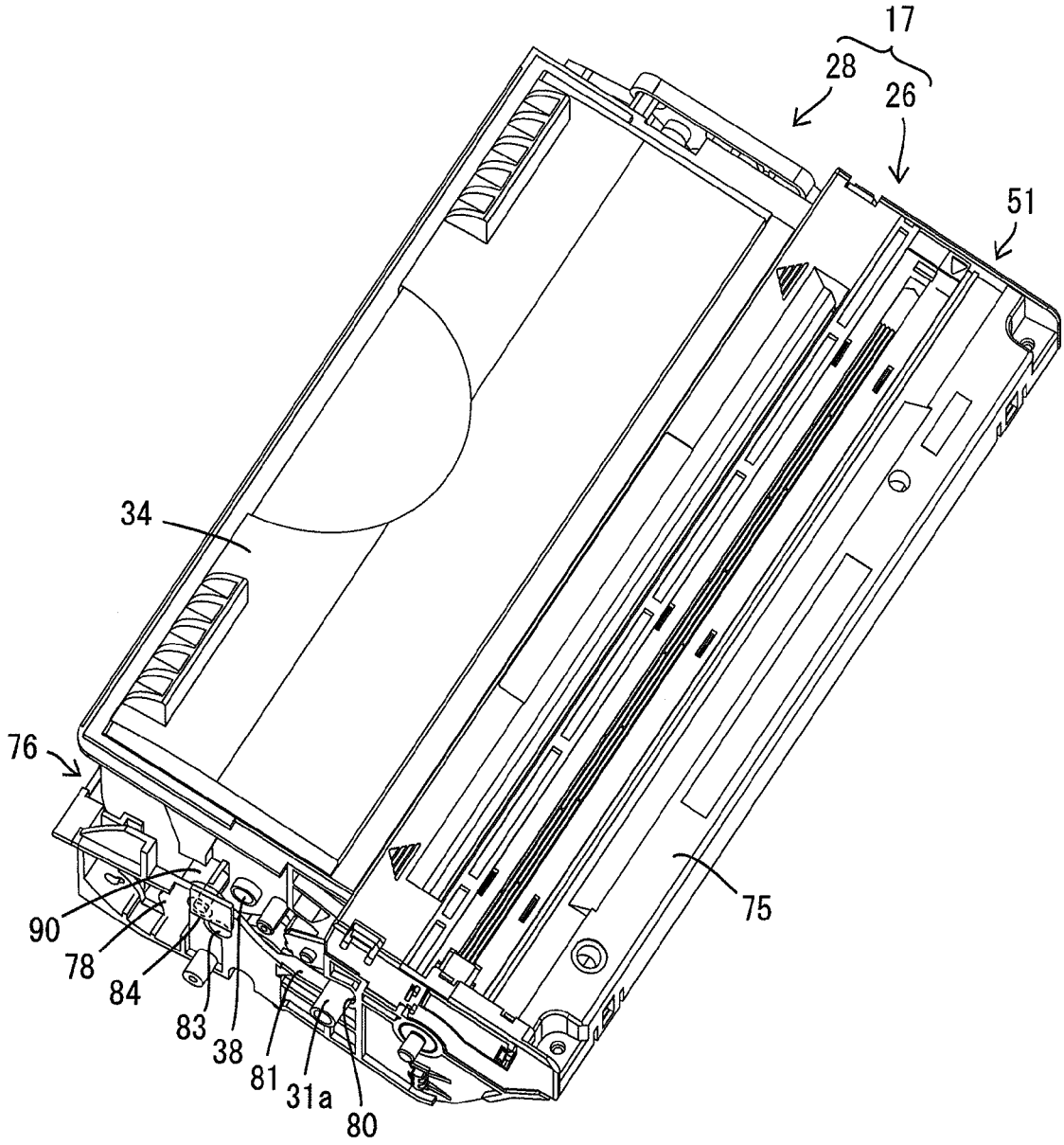
FIG. 10 is a perspective view of the developing cartridge set in the drum cartridge.
Figure 11:
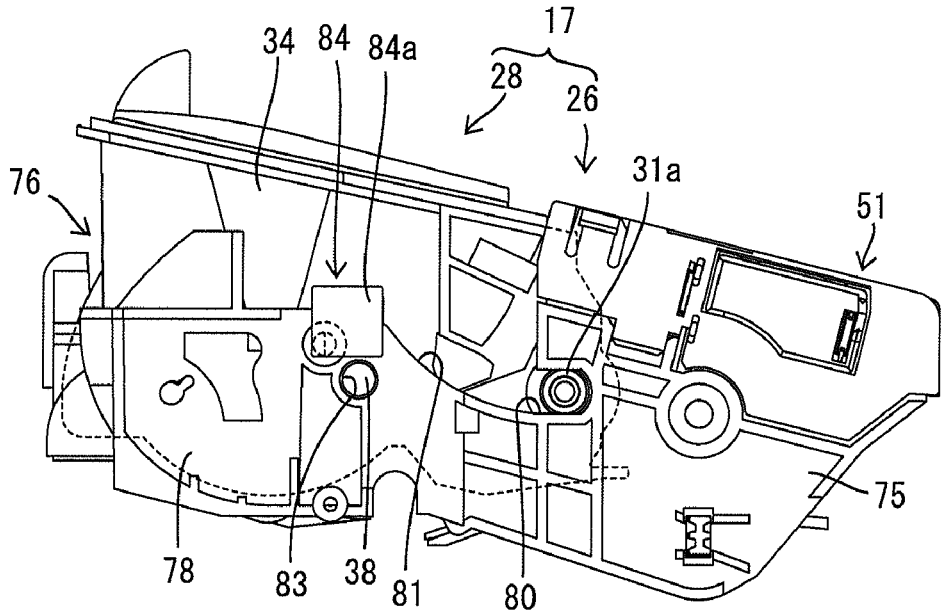
FIG. 11 is a side view of the developing cartridge set in the drum cartridge.

When the developing cartridge 28 is placed in its proper installation position in the drum cartridge 26, as shown in FIGS. 10 and 11, the guide surface 89 makes a flat contact with the rear portion 90*a* of the pressing portion 90, as shown in FIG. 9. Thus, the shielding member 84 is held in the unblocking position where the through hole 83 is exposed.

4. Detection of Residual Toner Amounts and Cartridge Installation Conditions

A process for detecting the residual toner amounts in the toner chamber 34 and the cartridge installation conditions using the residual toner amount detector 73 will be described in detail below.

Figure 12:
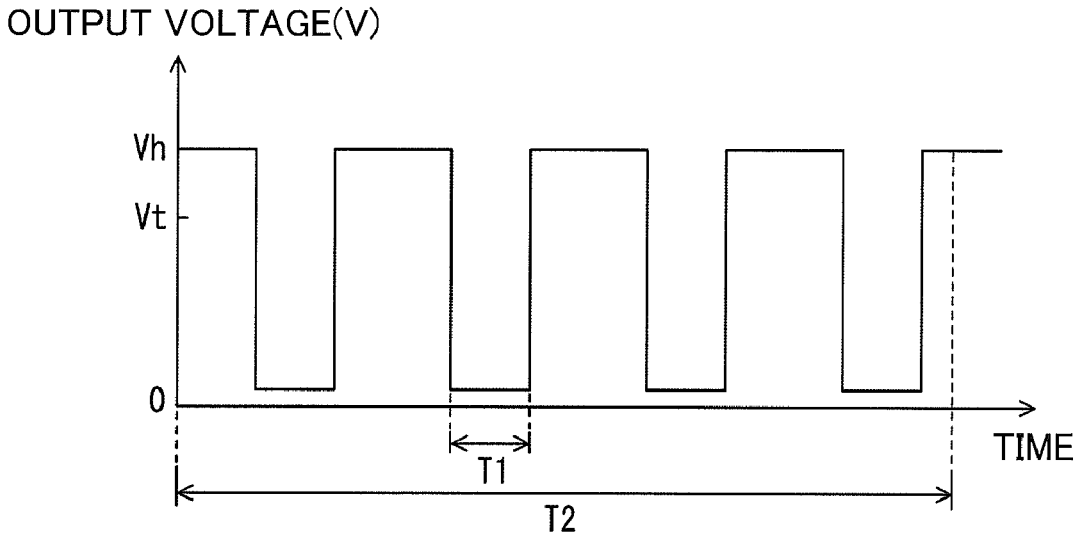
FIG. 12 is a graph showing changes of output voltages of a photoreceiver in a residual toner amount detector.

As described above, the photoreceiver 73*b* of the residual toner amount detector 73 outputs voltages according to the amount of the light beam received. As shown in FIG. 12, when an amount of the light beam received by the photoreceiver 73*b* is at a minimum, an output voltage V takes on values nearer to voltage Vh. When the amount of the light beam received by the photoreceiver 73*b* is at a maximum, the output voltage V takes on values nearer to zero (0). Values of the output voltage V change within the range of zero to voltage Vh, according to the amount of light received by the photoreceiver 73*b*. When the drum cartridge 26 and the developing cartridge 28 are properly installed in the main body frame 2 and the agitator 36 is rotated, the optical path for the light beam emitted from the phototransmitter 73*a* is regularly blocked by, for example, the agitated toner or the wiper 39 that wipes off the windows 38. Therefore, the output voltage V of the photoreceiver 73*b* changes in the same cycle as the rotation of the agitator 36, as shown in FIG. 12. The controller 60 reads an output from the photoreceiver 73*b*. The controller 60 determines that the amount of light received by the photoreceiver 73*b* is a low level when the output voltage V is higher than a predetermined threshold voltage value Vt and determines the amount to be a high level when the output voltage V is lower than the threshold value Vt. The controller 60 calculates the ratio R of the total number of times T1 in which the received light amount is high, to a measurement unit time T2. The ratio R becomes relatively high when the residual toner amount in the toner chamber 34 is small, because the time the toner intercepts the optical path of the light beam becomes relatively short. Conversely, the ratio R becomes relatively low when the residual toner amount is large, because the time the toner intercepts the optical path of the light beam becomes relatively long. As will be described in detail below, the controller 60 detects the residual toner amounts in the toner chamber 34 and installation/uninstallation of the respective cartridges 26, 28 based on the ratio R.

Figure 13:
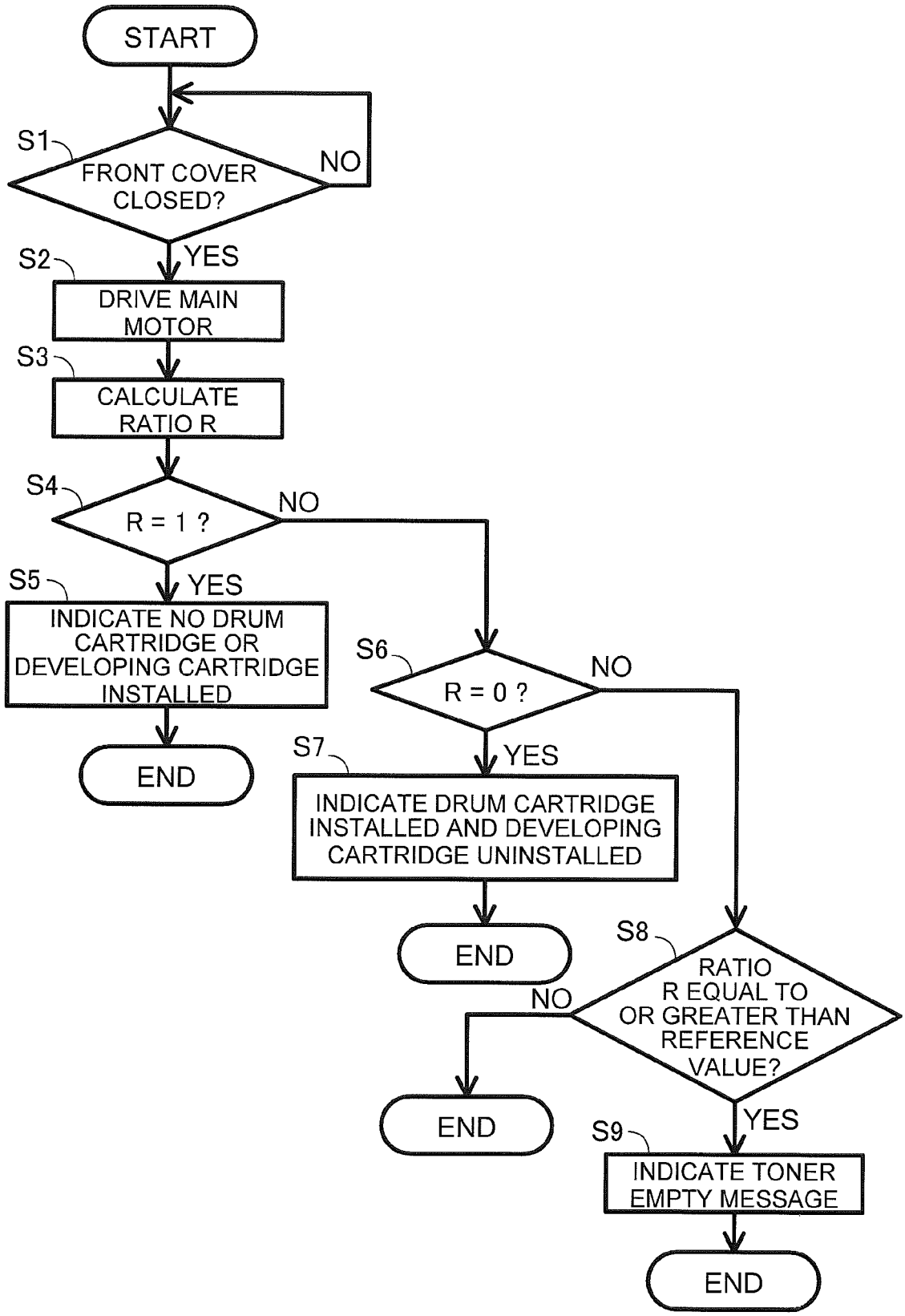
FIG. 13 is a flowchart showing a process for detecting cartridge installation conditions and residual toner amounts according to illustrative aspects.

The controller 60 performs the process for detecting the residual toner amounts in the toner chamber 34 and the installation/uninstallation of the cartridges 26, 28, when power is turned on, or the front cover 2*a* is closed. The process performed by the controller 60 when the front cover 2*a* is open will be described in detail below referring to FIG. 13.

In S1, the CPU 61 of the controller 60 determines whether the front cover 2*a* is closed, based on the signal received from the cover opening/closing detector 72. When it is determined that the front cover 2*a* is closed (S1: Yes), flow proceeds to S2 where the controller 60 drives the main motor 66 for a predetermined time via the control device 65. When the drum cartridge 26 and the developing cartridge 28 are installed in the main body frame 2, the drive force from the main motor 66 is transmitted to the agitator 36 and the agitator 36 is rotated for a predetermined time. In S3, the CPU 61 calculates the ratio R of the total number of times T1 in which the received light amount is high to the measurement unit time T2 based on the output voltage V of the photoreceiver 73*b*. Then, the CPU 61 determines whether the ratio R is one (1) in S4. When it is determined that the ratio R is one (1) (S4: Yes), a member that intercepts the light beam is not disposed between the phototransmitter 73*a* and the photoreceiver 73*b*. Therefore, it is determined that neither the drum cartridge 26 nor the developing cartridge 28 is installed in the main body frame 2. Thus, in S5, the CPU 61 indicates in the display 68 that the neither the drum cartridge 26 nor the developing cartridge 28 is installed in the main body frame 2 via the control device 65.

When it is determined that the ratio R is not one (1) (S4: No), the CPU 61 determines whether the ratio R is zero (0) in S6. When the ratio R is zero (0) (S6: Yes), it is determined that the drum cartridge 26 is installed but the developing cartridge 28 is not installed in the main body frame 2 because the shielding member 84 is placed in the blocking position, which blocks the optical path between the phototransmitter 73*a* and the photoreceiver 73*b*. Thus, in S7, the CPU 61 indicates on the display 68 that the drum cartridge 26 is installed while the developing cartridge 28 is not installed in the main body frame 2.

In S6, when the ratio R is not zero (0) (S6: No), it is determined that the ratio R is between 0 and 1 and the received light amount is changed in accordance with the rotation of the agitator 36. Thus, it is determined that the drum cartridge 26 and the developing cartridge 28 are installed in the main body frame 2. Then, the CPU 61 determines in S8 whether the ratio R is equal to or greater than a reference value. When it is determined that the ratio R is equal to or greater than the reference value (S8: Yes), the CPU 61 causes a toner empty message to be indicated on the display 68 because the residual toner amount in the toner chamber 34 is determined to be lower than a reference amount. When it is determined that the ratio R is lower than the reference value (S8: No), the CPU 61 does not cause the toner empty message to be indicated on the display 68 because the residual toner amount in the toner chamber 34 is determined to be equal to or greater than the reference amount.

Similarly, the CPU 61 of the controller 60 performs steps S2 to S9 when power is turned on. Thus, it is determined whether the cartridges 26, 28 are installed in the main body frame 2 and the residual toner amount in the toner chamber 34 is less than the reference amount.

When the developing cartridge 28 is separated from the drum cartridge 28, the light from the residual toner amount detector 73 is blocked by the shielding member 84. When the developing cartridge 28 is installed in the drum cartridge 28, the light from the residual toner amount detector 73 is not blocked by the shielding member 84. Thus, it may be determined that only the drum cartridge 26 or both the drum cartridge 26 and the developing cartridge 28 are installed in the main body frame 2, based on the received light amount.

When the developing cartridge 28 is installed in the drum cartridge 28, the shielding member 84 is moved to the unblocking position by the pressing portion 90 provided in the developing cartridge 28. Thus, the shielding member 84 may be moved according to the operations of installation or removal of the developing cartridge 28.

The shielding member 84 may be pivotally moved about the attachment shaft 84*b* between the blocking position to block the through hole 83, which allows the light to pass therethrough, and the unblocking position to expose the through hole 83. Thus, structures of the shielding member 84 can be simplified.

The shielding member 84 is urged by the spring 87 toward the blocking position from the unblocking position. Therefore, when the developing cartridge 28 is separated from the drum cartridge 26, the shielding member 84 may be moved to the blocking position promptly and reliably.

The agitator 36 and the residual toner amount detecting windows 38 are provided in the toner chamber 34. The installation/removal of the developing cartridge 28 and the drum cartridge 26 can be detected based on the amount of light received from the phototransmitter 73*a* by the phototransmitter 73*a*. More specifically, when neither the developing cartridge 28 nor the drum cartridge 26 is installed in the main body frame 2, the amount of received light is at a high level. When only the drum cartridge 26 is installed in the main body frame 2, the light is blocked by the shielding member 84, so that the amount of received light is at a low level. When both of the developing cartridge 28 and the drum cartridge 26 are installed in the main body frame 2, the received light amount changes between high and low levels in accordance with a toner agitating operation by the agitator 36. Thus, the installation of the developing cartridge 28 and the drum cartridge 26 may be detected. The residual toner amount detecting windows 38 can be used for detecting the installation of the developing cartridge 28 and the drum cartridge 26, so that the number of components to be used for detecting the installation of the cartridges 26, 28 may be reduced.

While this disclosure has been described in conjunction with the exemplary aspects outlined above, various alternatives, modifications, variations, improvements and/or substantial equivalents, whether known or may be presently unforeseeable, may become apparent to those having at least ordinary skill in the art. Accordingly, the exemplary aspects of the disclosure, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

In an aspect of the invention, a sensor for detecting the residual toner amounts also serves as a detector for detecting the installation of the cartridges. However, a detector for detecting the installation of the cartridges may be provided separately from the sensor for detecting the residual toner amounts.

What is claimed is:

1. A process cartridge for use in an image forming apparatus, comprising:

an image carrier cartridge having an image carrier configured to carry an electrostatic latent image thereon, the image carrier cartridge configured to be removably installed in a main body frame of the image forming apparatus; and a developing cartridge including a developer chamber configured to hold developer and a developing carrier configured to perform development by supplying the developer to the electrostatic latent image formed on the image carrier, the developing cartridge configured to be removably set in the image carrier cartridge;

wherein the image carrier cartridge further includes a shielding member configured to move between a blocking position where the shielding member blocks light emitted from a detector provided in the main body frame of the image forming apparatus and an unblocking position where the shielding member does not block the light emitted from the detector, and the shielding member is in the blocking position when the developing cartridge is removed from the image carrier cartridge and is in the unblocking position when the developing cartridge is set in the image carrier cartridge.

2. The process cartridge according to claim 1, wherein the developing cartridge further includes a pressing portion configured to press the shielding member placed in the blocking position and move the shielding member to the unblocking position when the developing cartridge is set in the image carrier cartridge.

3. The process cartridge according to claim 1, wherein the image carrier cartridge has a through hole configured to allow the light to pass therethrough, and the shielding member covers the through hole in the blocking position and exposes the through hole in the unblocking position.

4. The process cartridge according to claim 1, further comprising an urging member configured to urge the shielding member from the unblocking position to the blocking position.

5. The process cartridge according to claim 1, wherein an agitator configured to agitate the developer and a window for detecting a residual amount of the developer in the developer chamber are provided in the developer chamber, the window being configured to pass light therethrough.

6. An image forming apparatus, comprising:

a main body frame;

an image carrier cartridge having an image carrier configured to carry an electrostatic latent image thereon, the image carrier cartridge configured to be removably installed in the main body frame;

a developing cartridge configured to be removably set in the image carrier cartridge, the developing cartridge including a developer chamber configured to hold developer, an agitator configured to agitate the developer in the developer chamber, a window for detecting a residual amount of the developer in the developer chamber, the window being disposed on an outer wall of the developer chamber, and a developing carrier configured to perform development by supplying the developer to the electrostatic latent image formed on the image carrier;

a driver disposed in the main body frame, the driver being configured to apply drive force to the agitator;

a detector disposed in the main body frame, the detector being configured to emit light to the window and receive the light passing through the window;

a shielding member disposed in the image carrier cartridge, the shielding member being configured to move between a blocking position where the shielding member blocks the light emitted from the detector and an unblocking position where the shielding member does not block the light emitted from the detector, the shielding member being in the blocking position when the developing cartridge is removed from the image carrier cartridge and in the unblocking position when the developing cartridge is installed in the image carrier cartridge; and an installation detecting device configured to determine that neither the image carrier cartridge nor the developing cartridge is installed in the main body frame if an amount of light received by the detector is at a high level when the driver is driven, that the image carrier cartridge is installed in the main body frame while the developing cartridge is not installed in the main body frame if the amount of light received by the detector is at a low level when the driver is driven, and that the image carrier cartridge and the developing cartridge are installed in the main body frame if the amount of light received by the detector changes between the high level and the low level when the driver is driven.

7. An image carrier cartridge configured to be removably installed in a main body frame of an image forming apparatus, comprising:

an image carrier configured to carry an electrostatic latent image thereon, the image carrier cartridge configured to removably receive therein a developing cartridge including a developer chamber configured to hold developer and a developing carrier configured to perform development by supplying the developer to the electrostatic latent image formed on the image carrier; and a shielding member configured to move between a blocking position where the shielding member blocks light emitted from a detector provided in the main body frame and an unblocking position where the shielding member does not block the light emitted from the detector, the shielding member being in the blocking position when the developing cartridge is removed from the image carrier cartridge and in the unblocking position when the developing cartridge is installed in the image carrier cartridge.

8. The image carrier cartridge according to claim 7, further comprising a through hole configured to allow the light to pass therethrough, wherein the shielding member is pivotally supported so as to cover the through hole in the blocking position and expose the through hole in the unblocking position.

9. The image carrier cartridge according to claim 7, further comprising an urging member configured to urge the shielding member from the unblocking position to the blocking position.

10. A developing cartridge configured to be removably set in an image carrier cartridge having an image carrier configured to carry an electrostatic latent image thereon, the image carrier cartridge configured to be removably installed in a main body frame of an image forming apparatus, the developing cartridge comprising:

a developer chamber configured to hold developer;

a developing carrier configured to perform development by supplying the developer to the electrostatic latent image formed on the image carrier; and a pressing portion configured to press a shielding member disposed in the image carrier cartridge when the developing cartridge is set in the image carrier cartridge such that the shielding member is moved from a blocking position, where the shielding member blocks light emitted from a detector provided in the main body frame, to an unblocking position where the shielding member does not block the light emitted from the detector.

11. The developing cartridge according to claim 10, wherein an agitator configured to agitate the developer and a window for detecting a residual amount of the developer in the developer chamber are provided in the developer chamber, the window being configured to pass light therethrough.

* * * * *